United States Patent [19]

Grottola

[11] 4,030,399

[45] June 21, 1977

[54] CLOSED PEG BOX ON STRINGED INSTRUMENT

[76] Inventor: Oresto P. Grottola, 930 S. Velare St., Anaheim, Calif. 92804

[22] Filed: Dec. 24, 1975

[21] Appl. No.: 630,522

[52] U.S. Cl. ..... 84/304
[51] Int. Cl.² ..... G10D 3/14
[58] Field of Search ..... 84/304, 305, 306

[56] References Cited

UNITED STATES PATENTS

| | | | |
|---|---|---|---|
| 450,808 | 4/1891 | Faxon | 84/306 |
| 473,439 | 4/1892 | Abrams | 84/304 |

*Primary Examiner*—Stephen J. Tomsky

[57] ABSTRACT

The upper termination of strings on an instrument having a finger board or a fret board is into a peg box. The present peg box is closed on the front to protect the instrumentalist against the sharp loose ends of the stringed wire. The closed front of the box also provides an area for decoration and application of the maker's name.

4 Claims, 6 Drawing Figures

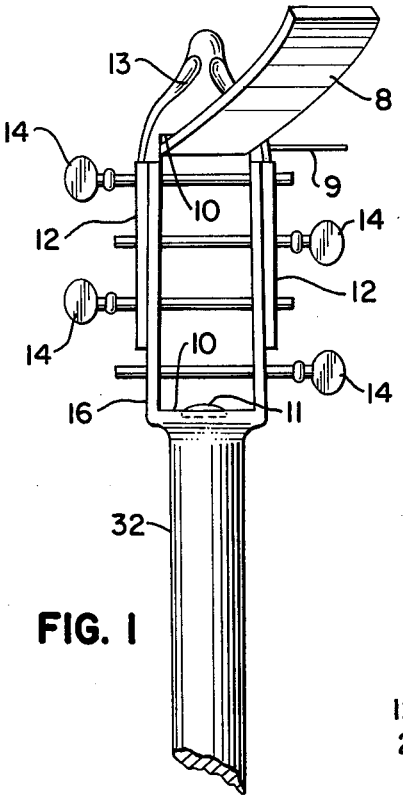
FIG. 1
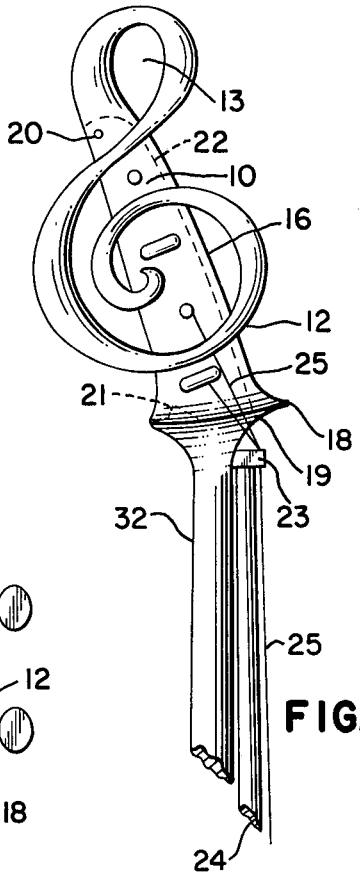
FIG. 2
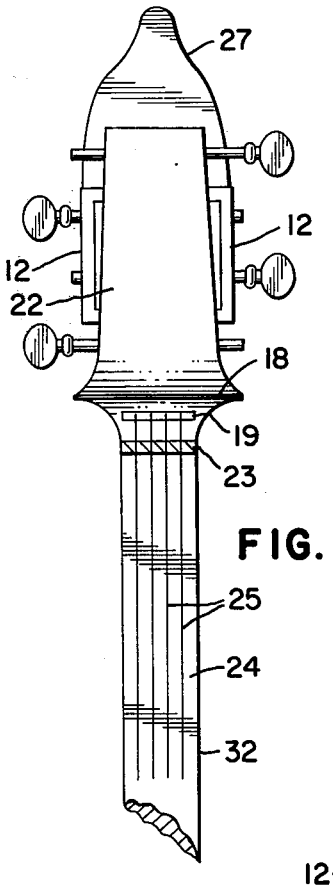
FIG. 3
FIG. 4
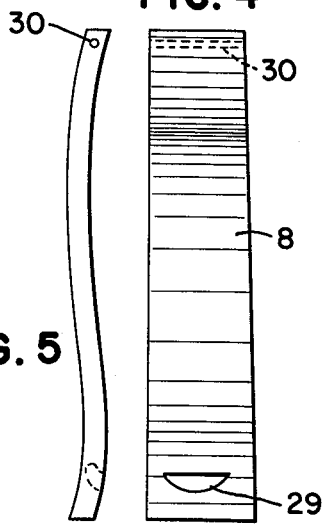
FIG. 5
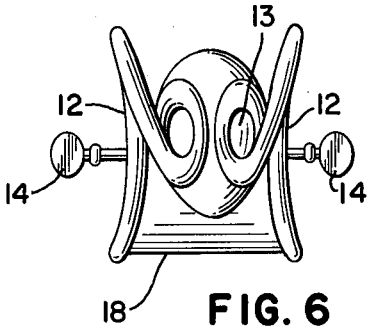
FIG. 6

CLOSED PEG BOX ON STRINGED INSTRUMENT

BACKGROUND

This invention relates to a new headpiece or a peg box for string instruments as in the viol class and the guitar class with the front of the peg box closed.

Conventionally, those stringed instruments which have a finger board or a fret board have their strings terminate at the outward portion of the instrument in a peg box or key box. Most of these instruments fall in the viol and guitar classes. In the viol class, the peg box is open to the front; in the guitar class, the key box is open all the way through. The strings are brought up along the finger board of fret board across the nut into the peg box. There they are wound up to adjust the string tension which controls the frequency of spring vibration and thus the tone. While they are called strings, in many of these instruments the string is of stell wire and, in any event, the string is very stiff. When the string is wrapped around the adjusting tags or shaft, the free end of the string can extend from the open side of a peg box. This is unsightly and can hurt the instrumentalist.

SUMMARY

In order to aid in the understanding of this invention, it can be stated in essentially summary form that it is directed to a peg box which is closed on the front and is useful for stringed instruments in the viol and guitar classes.

It is thus an object of this invention to provide a peg box for a stringed instrument which is closed in the front to protect the instrumentalist against the loose end of the string. It is another object to provide the peg box which is closed on the front to provide an additional area for decoration of the stringed instrument. It is a further object to provide a further preferred embodiment of the closed peg box for a stringed instrument wherein both the front and back of the peg box are closed for the protection of the instrumentalist, and the back is closed by an openable door for access to the pegs for string attachment.

Other objects and advantages of this invention will become apparent from a study of the following portion of the specification, the claims, and the attached drawings.

BRIEF DESCRIPTION OF THE DRAWINGS

FIG. 1 is a back view of a neck of a viol class or guitar class stringed instrument showing the preferred embodiment of the closed peg box of this invention as applied thereto.

FIG. 2 is a side view of the structure of FIG. 1.

FIG. 3 is a front view thereof.

FIG. 4 is an enlarged, detailed view of the openable peg box door, as seen from the rear of the instrument.

FIG. 5 is an edge view of the door of FIG. 4.

FIG. 6 is an end-elevational view of the neck of the stringed instrument showing the details of the decorative scroll-work in association with the closed peg box.

DESCRIPTION

The peg box 16 of this invention is described in its preferred embodiment in FIGS. 1 through 5 where it is shown in association with a musical instrument having a neck 32. The neck 32 is the neck of a stringed instrument wherein the pitch of the string 25 is controlled by manually pressing it against finger board 24. These stringed instruments are in the viol class (including violin, viola, cello, and bass), but the peg box 16 is also applicable to similar stringed instruments, such as the guitar.

Peg box 16 is characterized by the closed front surface 22 which provides a surface of more attractive character, even undecorated, than the former directly visible pegs and encloses the peg box so that ends of the strings are contained and controlled so that the instrumentalist's fingers are not hurt by them. The closed front surface 22 extends to the limits 18 shown in FIG. 3. The closed front surface can be decorated or can carry the instrumentalist's or instrument maker's insignia.

As is seen in FIG. 1, the peg box 16 is open in the back and is defined by wall 10 of the peg box well. Pegs 14 extend through the sidewalls of the peg box so that strings may be secured therethrough and have their tension adjusted by turning of the pegs. Strings 25 extend up over nut 23 (see FIGS. 2 and 3) and through string mouth 19 under nose 18 from the front of the finger board 24 into the interior of the peg box. Nose 18 preferably extends outward, as shown in FIG. 2, for both decorative purposes and to strengthen the closed front wall of the peg box adjacent string mouth 19.

Door 8 (see FIGS. 1, 4, and 5) is pivoted to open and close the open back of the peg box. Pivot pin 9 extends through pivot pin board 20 in the peg box and pivots in bore 30 in the door. Door stop 21 is positioned inside the peg box well to stop the door when it is flush in the peg box. Spring 11 is a detent spring secured in the peg box wall to engage and resiliently restrain door 8 in the closed position. Finger tip engagement depression 29 permits digital engagement of peg box door 8 to withdraw from its retaining spring out of the peg box well to open the closed peg box door for access to the interior of the peg box well. When the interior access is obtained, new strings can be installed. With the peg box door closed, finish appearance is obtained together with protection against the sharp ends of the strings.

The outer end of the instrument neck carrying the peg box 16 of this invention can be decorated in a number of attractive ways. The preferred decoration comprises clef scroll 12 which has a loop 13 at its upper end. Loop 13 can be used to hang the instrument, to attach further decoration as a tassel, or to attach a utilitarian and decorative device such as a guitar strap.

It is also important to note that the closing of the peg box improves the instrument tone, apparently because the vibrating free ends of the instrument's strings cannot directly radiate sounds outward. This is particularly true for the instrumentalist, who is very close to these vibrating free string ends.

The "Closed Peg Box for Stringed Instruments" of FIGS. 1 through 5 consists of a hollowed-out peg box well having at its rear a hinged door for access to strings. G-clef scrolls seen in FIG. 6 are on left and right side of peg box. A loop is located at the top of the peg box which is the top of the G-clef scroll. Below the peg box is the neck. All the following dimensions and measurements are for a specific embodiment of a standard size violin.

DRAWINGS

Drawings should be made in exact detail showing measurements and scale of the structure of this invention. Make drawings of left and right view, front view and back view.

The overall measurement of the unit headpiece from top of the loop to the bottom of neck is 11 inches. From the top of the loop to the point of the nose is 5¼ inches. From the point of the "nose" to the bottom of the neck is 5¾ inches. The front and back of the peg box body which is between clefs on both sides should measure 1⅛ inches in width when cut out. The combined width of peg box and scrolls on each side measures to 1 11/16 inches.

FRONT VIEW

The point of nose width is 1⅜ inches then curves upward and up 5 1/6 inch becoming part of the peg box body which runs upward for 3 inches then curves outward sharply almost pear-shaped, which is the loop at the top. The structure from the nose point to the top of the loop is 5⅝ inches. The string mouth directly below the curved part of the nose is 3/16 inch in height by 15/16 inch in width. The neck is 1¼ inches wide at the bottom then tapers to 15/16 inch just one fourth inch below the string mouth.

SIDE VIEW MEASUREMENTS

From protruding nose point to the back of the peg box is 1⅜ inches. The widest part of the clef's width is 2¾ inches; the loop at the top of the clef is 1⅝ inches; while the pear-shaped cutout in the center of the loop is 13/16 inch wide by 1 3/16 inches long.

HARDWOODS

The hardwoods preferred for making any instrument headpiece are rose, cherry or maple. Cherry was used for making several models of this Closed Peg Box for Stringed Instruments, but persons skilled in the art can use hardwoods of their own choice. After selecting the wood, a block is cut on a table saw approximately 2⅜ inches thick by 3½ inches wide by 12 inches long.

MAKING ALUMINUM TEMPLATES

From the full-size drawings, templates are cut out from a thin gauge aluminum plate which is sturdy but pliable enough to cut and bend templates to the desired contour and form. It is recommended that a template be made for each of the four sides, but each template should be made in two parts. One template covers the front top half and is shaped and contoured from the point of the nose upward along the peg box body. On this template, disregard the half-round clef emblem on either side. At the crutch of the loop form the template outward seven eighths inch and bend it to pear-shape to top of loop. The lower half of the template starts at the point of the nose, then extends one fourth inch in an inward curve, then is a straight pattern to the bottom of the neck. Follow the same pattern for making the templates for the left and right sides of the headpiece. The back template is shaped from the bottom of peg box to top of loop. The lower half of the back template butts at the bottom of the peg box then is rounded inward. This is called the thumb-stop. The template is then shaped to a half-round to the bottom of the neck and tongue. Additionally, to form the back, a template is fitted to the peg box body only then extended upward to the top of the curved loop. The rounded curves of the G-clefs on either side of peg box body are not needed on the back template, as the left and right templates fully cover the clefs' width, height and design. Chisels and a mushroom power sander are most effective to round off back of neck and tongue. They are then hand-finished with sandpaper.

MARKING AND CUTTING THE WOOD

Starting with the set of left templates, placing them down on the 3½ inch side of the wood, the front of peg box and flat part of neck will be facing to the right. The templates must butt at center. The bottom template, which is the neck, will be held approximately one fourth inch in from the edge and also parrallel with the edge of the wood. The top half template is moved toward the left of the wood to the point reaching a radius of 17° angle from the bottom straight template. Before marking, be sure templates butt in center. Now, with pencil, outline around both templates, also the inner cut-outs and piercework of the clef and nose. With a fine bandsaw, cut around the outer marking of the template leaving approximately the 1/16 inch pencil mark for future filing and sanding. Next, drill holes in clef's piercework or cut-outs and in center of loop large enough for a sabre saw blade to fit through. Be sure to use a heavy duty sabre saw with the blade for cutting hardwood, cut out all the marked-out piercework and also the oval design inside of loop. Next, with a rotary motor, file smooth the cut-outs to template pencil markings. For the next operation, one should use the smallest router or a hand "Dremel Moto Tool" with variable speeds. They are about 6½ inches long and 1¾ inches in diameter. Using a small router bit in the Dremel, rout out one fourth inch down between the clef designs over the peg box body, being sure not to cut any deeper than one fourth inch or you will be cutting away the peg box sides which are approximately one fourth inch thick. Next, round off all the edges and inserts of the clef design and peg box body with a coarse sandpaper and finish off with a finer sandpaper. Turn the wood over on its opposite side and repeat the same operation. Always check your work with the templates and make minor corrections.

CUTTING OUT BETWEEN CLEF DESIGNS ON FRONT

Measure 1 inch between the two lower curves of the clef and draw a straight line on both sides. The thickness of the clef design will be one fourth inch. Now, with whatever saw is most handy to the individual — a coping, hack, or dovetail saw — cut on the lines as far down as possible to the peg box body mark, but be careful not to cut into the loop which protrudes on front seven eighths inch out from peg box body and on back side protrudes 5/16 inch from the peg box body. Now, chisel down to the peg box body mark which is marked on left and right sides. The upper part which is pear-shaped and called the "loop" is rounded off with a mushroom motor sander then by hand with a finger sandpaper. Round all edges of the design with whatever means of sanding best suits the maker. This operation is done exactly the same on the back side of the unit and is checked with the contoured templates. The front flat length of the neck from bottom to point of nose is 5¾ inches. The back length, which is rounded, is 5⅜ inches from bottom of the tongue to bottom of peg box. The ⅜ inch difference in length between front and back is because the tongue has a radius through a 84° angle from the flat front of the neck. The tongue is 1 11/16 inches wide measuring from the front of the neck and tapers to 11/16 inch half-round at the end.

The neck is the easiest part to make. The front is straight and measures 1¼ inches at the bottom, then tapers up to 15/16 inch just directly below string mouth. The sides and back can be rounded with a mushroom sander or half-round rasp and file then finished off with a fine sandpaper and finally a pumice paper.

MARKING, DRILLING AND CUTTING OUT PEG-BOX WELL

Be sure to mark the peg-box well squarely on center of peg-box body. The length of peg-box well is 3⅜ inches by seven eighths inch in width. This is marked off with a pencil. Now, drill down just inside the marks about five eighths inch using a metal bit instead of a wood bit, since a wood bit has a long screw point at end and it could possibly puncture through opposite side of peg-box. Now, with sharp chisel, square the sides and corners to pencil marks, dig down to three fourths inch using a bent firmer or skew chisel. Smooth the sidewalls with a file.

At the bottom of the peg-box opening, just 3/16 inch below the face of body, cut out a ⅜ inch dovetail and fit a piece of tension spring between the dovetail cut-out. This small tension plate is installed to releasably hold the peg-box door. Next, cut the door 1/32 inch shorter in length and width of the well opening and 3/16 inch thick. The door will be hinged at its top, so it will be necessary to bullnose the top so the door will not bind. Hold the door in place flush with top of the peg-box body and then drill a 1/16 inch hold through left side of peg-box — 3/16 inch below the top of opening — through the door and halfway into opposite side of peg-box wall. Using a long enough wire brad nail for hinging, drive the brad through peg-box wall and door, snip off it too long, and drive it in tight with a nail set.

PEG OR KEY HOLES

Make a template for the exact spacing of the peg-holes and mark them on both sides. Then, using a ¼ drill bit, drill out the four peg-holes, drilling through both sides of peg-box walls. As pegs and a rattail file are tapered exactly the same degree, use the file to taper the holes to fit the pegs. Taper two on right side, two on left side.

DRILLING STRING MOUTH INTO PEG-BOX WELL

The string mouth measures 3/16 inch by 13/16 inch in width and 3/16 inch down from point of nose. Drill up into the peg-box well at a 35° angle. After drilling, use a thin flat file to square off the string mouth. Finally, sand off the whole unit with pumice sandpaper.

Glue the lower part of the neck and tongue of this new Closed Peg-Box for String Instruments to the top rib block. Next, glue on the back to rib. Glue on the bassbar inside of belly a day before to set, then glue belly to ribs and clamp. Install the nut, fingerboard, tailpiece and pegs. Next, clip strings onto the tailpiece and run them along the fingerboard over the nut, through the string mouth and into peg-box well. Attach the strings to pegs. Place the bridge between the G-holes and put in the sound post through the right F-hole. Now tighten the strings, and the instrument is complete.

The present-day scrolls for the viol class instruments, such as the violin, viola da Gama, viol, bass, etc., are called "Volute Scrolls." Although they have been made for many years, for the most part they are hand-made, as is my structure, the Closed Peg-Box For String Instruments.

This invention having been described in its preferred embodiment, it is clear that it is susceptible to numerous modifications and embodiments within the ability of those skilled in the art and without the exercise of the inventive faculty. Accordingly, the scope of this invention is defined by the scope of the following claims.

What is claimed is:

1. A peg box for a stringed musical instrument having a neck, said peg box comprising:

peg box walls defining a peg box well and at least one rotatable shaft extending into said peg box well through one of said peg box walls for the attachment of a musical instrument string to said rotatable shaft for adjusting the tension and pitch of the string;

said peg box having an imperforate permanently positioned top wall to cover said shaft in said peg box well;

said neck having a finger board, said finger board terminating in a nut, a string mouth positioned between said top wall and said nut and extending into said peg box well to permit entry of strings into said peg box well;

said peg box having an open back to permit access into said peg box well; and a pivoted peg box door mounted on said peg box and positioned to selectively close the open back of said peg box well.

2. The peg box of claim 1 further including a door stop in said peg box well for engagement by said peg box door in its closed position and means for manual grasping on said peg box door to permit manual engagement and opening of said peg box door.

3. The peg box of claim 2 further including a spring for interengagement between said peg box door and said peg box walls for restraining said peg box door in its closed position.

4. The peg box of claim 3 further including a scroll secured to each side of said peg box, said scroll having a closed loop.

* * * * *